US006138360A

United States Patent [19]

Owens, Sr. et al.

[11] Patent Number: 6,138,360

[45] Date of Patent: Oct. 31, 2000

[54] NAIL CLIPPER ACCESSORY

[76] Inventors: Randy J. Owens, Sr.; Gidget T. Owens, both of 1514 Switzer La., New Iberia, La. 70560

[21] Appl. No.: 09/373,280

[22] Filed: Aug. 12, 1999

[51] Int. Cl.[7] ..... B26D 7/18

[52] U.S. Cl. ..... 30/28; 132/75

[58] Field of Search ..... 30/133, 28, 138, 30/124; 132/73.5, 73.6, 75, 75.6, 76.4; D28/60

[56] References Cited

U.S. PATENT DOCUMENTS

| | | | |
|---|---|---|---|
| 3,606,681 | 9/1971 | Rogers et al. | 30/133 |
| 3,807,406 | 4/1974 | Rafferty et al. | 128/318 |
| 4,314,405 | 2/1982 | Park | 30/133 |
| 4,407,068 | 10/1983 | Wilson | 30/133 |
| 4,478,232 | 10/1984 | Yasuda | 132/73.6 |
| 4,985,999 | 1/1991 | Iwasaki et al. | 30/206 |
| 5,031,320 | 7/1991 | Persyn | 30/133 |
| 5,031,364 | 7/1991 | Belanger | 30/133 |
| 5,117,847 | 6/1992 | May | 132/75.5 |
| 5,261,160 | 11/1993 | Castagna | 30/75 |
| 5,332,163 | 7/1994 | Schnizler | 30/133 |
| 5,377,411 | 1/1995 | Andriotis | 30/133 |
| 5,465,740 | 11/1995 | Kim | 132/73.6 |
| 5,632,288 | 5/1997 | Webb | 132/75.5 |
| 5,653,024 | 8/1997 | Cartagenova | 30/28 |
| 5,724,736 | 3/1998 | Smith | 30/133 |
| 5,797,407 | 8/1998 | David et al. | 132/73.6 |
| 5,924,202 | 7/1999 | Romani | 30/133 |

*Primary Examiner*—Rinaldi I. Rada
*Assistant Examiner*—Omar Flores-Sanchez
*Attorney, Agent, or Firm*—Joseph N. Breaux

[57] ABSTRACT

A nail clipper accessory provides a vacuum for collecting the clippings as they are created when using a nail clipper and storing the clippings in a vacuum chamber for later disposal. The accessory is used with convention nail clippers by slipping the rear portion of the nail clipper into a resilient tubular shroud structure. The nail clipper accessory also includes a motor driven filing stone. To reduce the number of motors required for the accessory, the same motor is used to power the vacuum fan and the motor driven filing stone.

1 Claim, 3 Drawing Sheets

NAIL CLIPPER ACCESSORY

TECHNICAL FIELD

The present invention relates to nail clippers and the like and more particularly to a nail clipper accessory that includes a vacuum assembly and a resilient tubular clipper shroud structure; the tubular clipper shroud structure being formed of a resilient flexible plastic and having a clipper lever shaft positioning slot formed into a top front surface thereof, an open front end for receiving a back portion of a nail clipper and an open rear end in connection with a vacuum chamber of the vacuum assembly; the vacuum assembly including a molded plastic housing including a removable, vented filing stone cover, a pivoting vacuum chamber access door, a shroud connection opening in connection with the open rear end of the clipper shroud structure, a number of vacuum fan exhaust openings formed through a back plate surface thereof, a battery chamber formed therein, a DC motor cavity formed therein, a vacuum chamber formed therein and a screen support structure positioned between the vacuum chamber and the DC motor cavity; a dual shaft DC motor positioned within the DC motor cavity having a first output shaft passing through the back plate surface and in connection with a filing stone and a second output shaft in connection with a vacuum fan positioned within the DC motor cavity between the DC motor and the screen support structure, an intake end of the vacuum fan being oriented toward the screen support structure and an output end of the vacuum fan being oriented toward the back plate surface; an on/off switch with an actuator portion extending out of the molded housing; a battery connector in connection with the on/off switch and the DC motor and positioned within the battery chamber of the molded housing; and a screen positioned in connection with the screen support structure and sized to block an opening formed between the DC motor cavity and the vacuum chamber; the vacuum fan drawing air in through the clipper shroud structure, the vacuum chamber, and the screen and discharging the air out through the DC motor cavity, and the vacuum fan exhaust openings formed through the back plate surface of the molded housing when the DC motor is in operation; the removable, vented filing stone cover being attachable to the molded plastic housing such that the filing stone is concealed therein.

BACKGROUND ART

Proper nail care often requires nail clipping to be performed. Although nail clipping is necessary many individuals find it objectionable to handle the clippings that result. It would be desirable, therefore, for these individuals to have a nail clipper accessory that provided a vacuum for collecting the clippings as they are created and storing them in a vacuum chamber for later disposal that could be used with a convention nail clipper by slipping the rear portion of the nail clipper into a resilient tubular shroud structure. Because filing is often required after clipping, it would be further desirable to have a nail clipper accessory that also included a motor driven filing stone. To reduce the number of motors required for the accessory it would be further benefit if the same motor could be used to power the vacuum and the motor driven filing stone.

GENERAL SUMMARY DISCUSSION OF INVENTION

It is thus an object of the invention to provide a nail clipper accessory that includes a vacuum assembly and a resilient tubular clipper shroud structure; the tubular clipper shroud structure being formed of a resilient flexible plastic and having a clipper lever shaft positioning slot formed into a top front surface thereof, an open front end for receiving a back portion of a nail clipper and an open rear end in connection with a vacuum chamber of the vacuum assembly; the vacuum assembly including a molded plastic housing including a removable, vented filing stone cover, a pivoting vacuum chamber access door, a shroud connection opening in connection with the open rear end of the clipper shroud structure, a number of vacuum fan exhaust openings formed through a back plate surface thereof, a battery chamber formed therein, a DC motor cavity formed therein, a vacuum chamber formed therein and a screen support structure positioned between the vacuum chamber and the DC motor cavity; a dual shaft DC motor positioned within the DC motor cavity having a first output shaft passing through the back plate surface and in connection with a filing stone and a second output shaft in connection with a vacuum fan positioned within the DC motor cavity between the DC motor and the screen support structure, an intake end of the vacuum fan being oriented toward the screen support structure and an output end of the vacuum fan being oriented toward the back plate surface; an on/off switch with an actuator portion extending out of the molded housing; a battery connector in connection with the on/off switch and the DC motor and positioned within the battery chamber of the molded housing; and a screen positioned in connection with the screen support structure and sized to block an opening formed between the DC motor cavity and the vacuum chamber; the vacuum fan drawing air in through the clipper shroud structure, the vacuum chamber, and the screen and discharging the air out through the DC motor cavity, and the vacuum fan exhaust openings formed through the back plate surface of the molded housing when the DC motor is in operation; the removable, vented filing stone cover being attachable to the molded plastic housing such that the filing stone is concealed therein.

Accordingly, a nail clipper accessory is provided. The nail clipper accessory includes a vacuum assembly and a resilient tubular clipper shroud structure; the tubular clipper shroud structure being formed of a resilient flexible plastic and having a clipper lever shaft positioning slot formed into a top front surface thereof, an open front end for receiving a back portion of a nail clipper and an open rear end in connection with a vacuum chamber of the vacuum assembly; the vacuum assembly including a molded plastic housing including a removable, vented filing stone cover, a pivoting vacuum chamber access door, a shroud connection opening in connection with the open rear end of the clipper shroud structure, a number of vacuum fan exhaust openings formed through a back plate surface thereof, a battery chamber formed therein, a DC motor cavity formed therein, a vacuum chamber formed therein and a screen support structure positioned between the vacuum chamber and the DC motor cavity; a dual shaft DC motor positioned within the DC motor cavity having a first output shaft passing through the back plate surface and in connection with a filing stone and a second output shaft in connection with a vacuum fan positioned within the DC motor cavity between the DC motor and the screen support structure, an intake end of the vacuum fan being oriented toward the screen support structure and an output end of the vacuum fan being oriented toward the back plate surface; an on/off switch with an actuator portion extending out of the molded housing; a battery connector in connection with the on/off switch and the DC motor and positioned within the battery chamber of the molded housing; and a screen positioned in connection with the screen support structure and sized to block an opening formed between the DC motor cavity and the vacuum chamber; the vacuum fan drawing air in through the clipper shroud structure, the vacuum chamber, and the screen and discharging the air out through the DC motor cavity, and the vacuum fan exhaust openings formed through the back plate surface of the molded housing when the DC motor is in operation; the removable, vented filing stone cover being attachable to the molded plastic housing such that the filing stone is concealed therein.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
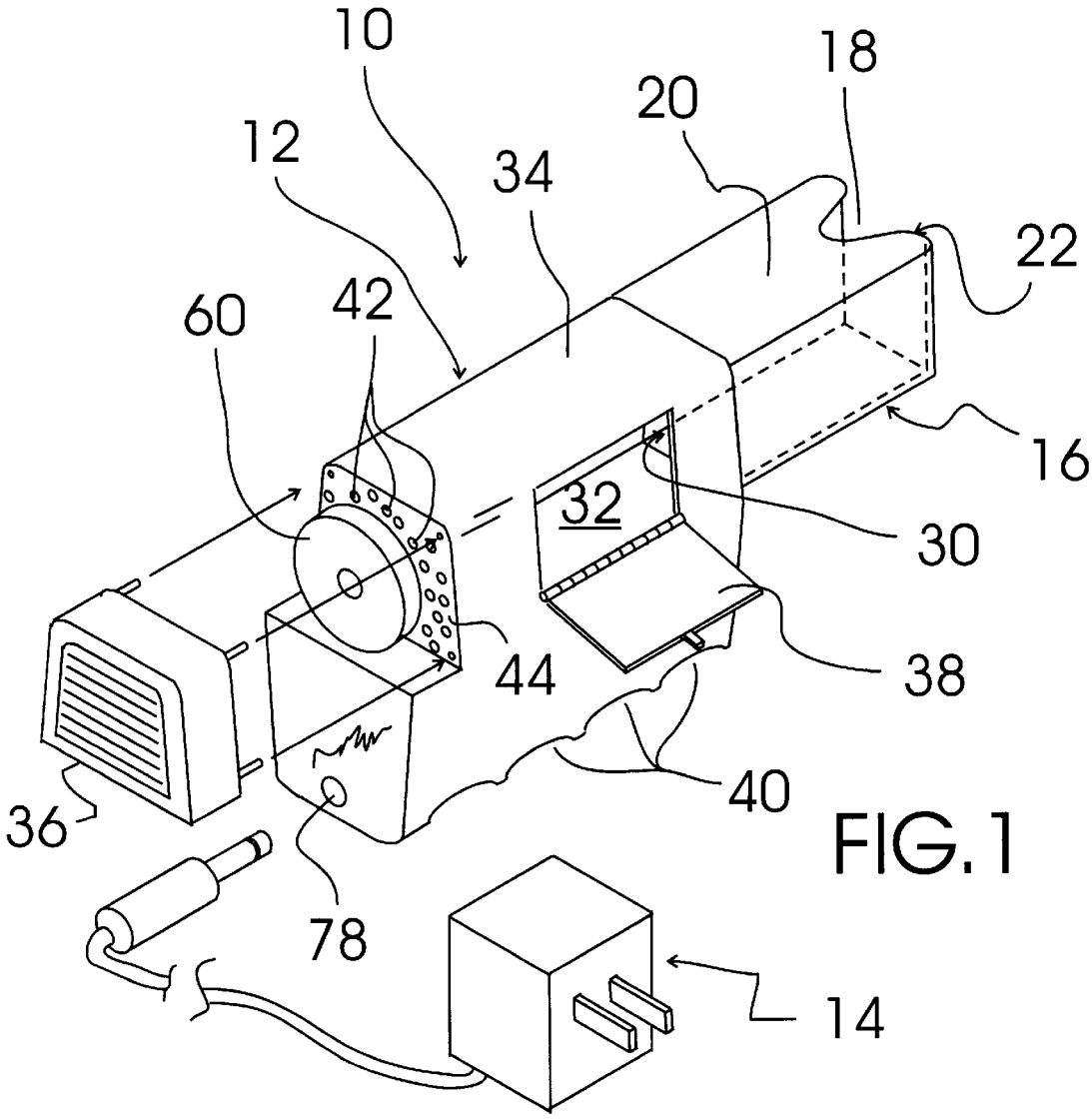
FIG. 1 is a perspective view of an exemplary embodiment of the nail clipper accessory of the present invention showing the vacuum assembly, the AC/DC adapter, and the resilient tubular clipper shroud structure; the tubular clipper shroud structure being formed of a resilient flexible plastic and having a clipper lever shaft positioning slot formed into a top front surface thereof, an open front end for receiving a back portion of a nail clipper and an open rear end in connection with a vacuum chamber of the vacuum assembly; the vacuum assembly including a molded plastic housing including a removable, vented filing stone cover, a pivoting vacuum chamber access door, a shroud connection opening in connection with the open rear end of the clipper shroud structure, a number of finger receiving grooves formed into a bottom surface thereof, a number of vacuum fan exhaust openings formed through a back plate surface thereof, a battery chamber formed therein, a DC motor cavity formed therein, a vacuum chamber formed therein and a screen support structure positioned between the vacuum chamber and the DC motor cavity; a dual shaft DC motor positioned within the DC motor cavity having a first output shaft passing through the back plate surface and in connection with a filing stone and a second output shaft in connection with a vacuum fan positioned within the DC motor cavity between the DC motor and the screen support structure, an intake end of the vacuum fan being oriented toward the screen support structure and an output end of the vacuum fan being oriented toward the back plate surface; an on/off switch with an actuator portion extending out of the molded housing; a battery connector in connection with an AC/DC adapter jack, the on/off switch and the DC motor and positioned within the battery chamber of the molded housing; and a screen positioned in connection with the screen support structure and sized to block an opening formed between the DC motor cavity and the vacuum chamber; the vacuum fan drawing air in through the clipper shroud structure, the vacuum chamber, and the screen and discharging the air out through the DC motor cavity, and the vacuum fan exhaust openings formed through the back plate surface of the molded housing when the DC motor is in operation; the removable, vented filing stone cover being attachable to the molded plastic housing such that the filing stone is concealed therein.

FIG. 1 shows an exemplary embodiment of the nail clipper accessory of the present invention generally designated 10. Nail clipper accessory 10 includes a vacuum assembly, generally designated 12; an AC/DC adapter, generally designated 14; and a resilient tubular clipper shroud structure, generally designated 16. Tubular clipper shroud structure 16 is formed from resilient flexible plastic and has a clipper lever shaft positioning slot 18 formed into a top front surface 20 thereof, an open front end 22 (see also FIG. 2) for receiving a back portion 26 (FIG. 2) of a nail clipper 28 (FIG. 2) and an open rear end 30 in connection with a vacuum chamber 32 of vacuum assembly 12.

Figure 2:
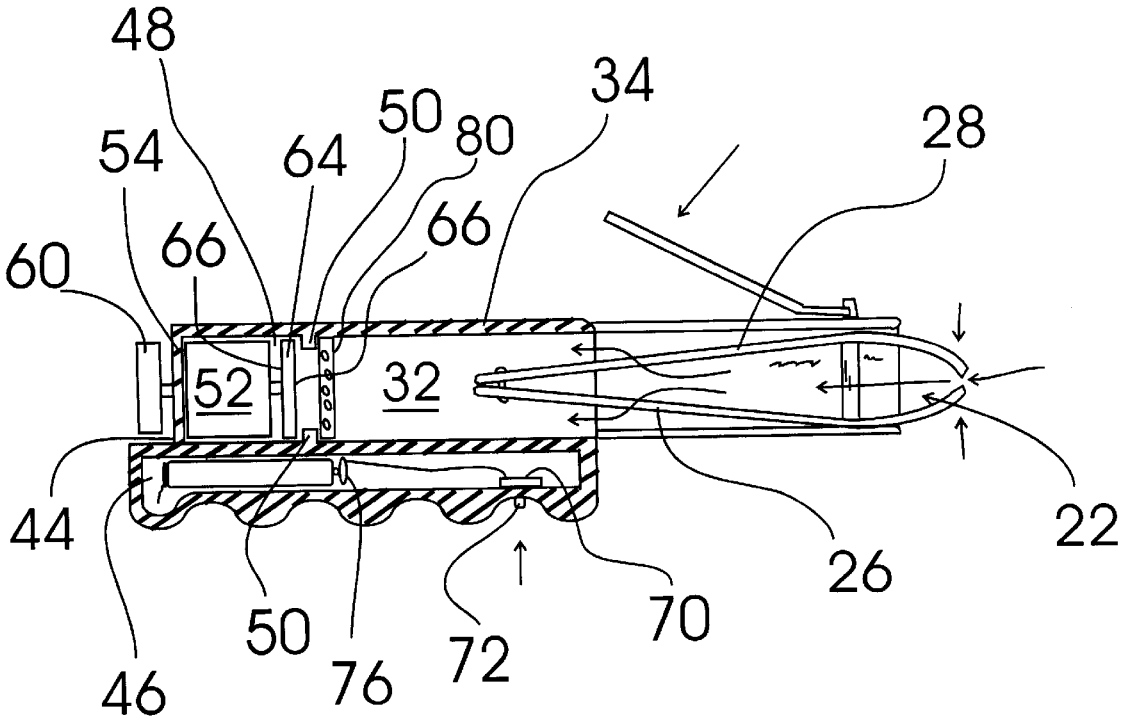
FIG. 2 is a sectional view showing the tubular clipper shroud structure with a back portion of a representative nail clipper inserted therein and the vacuum assembly including the shroud connection opening in connection with the open rear end of the clipper shroud structure, the finger receiving grooves, the battery chamber, the DC motor cavity, the vacuum chamber, the screen support structure, the screen, the DC motor, the filing stone, the vacuum fan, the on/off switch, the battery connector, and a representative battery.
Figure 3:
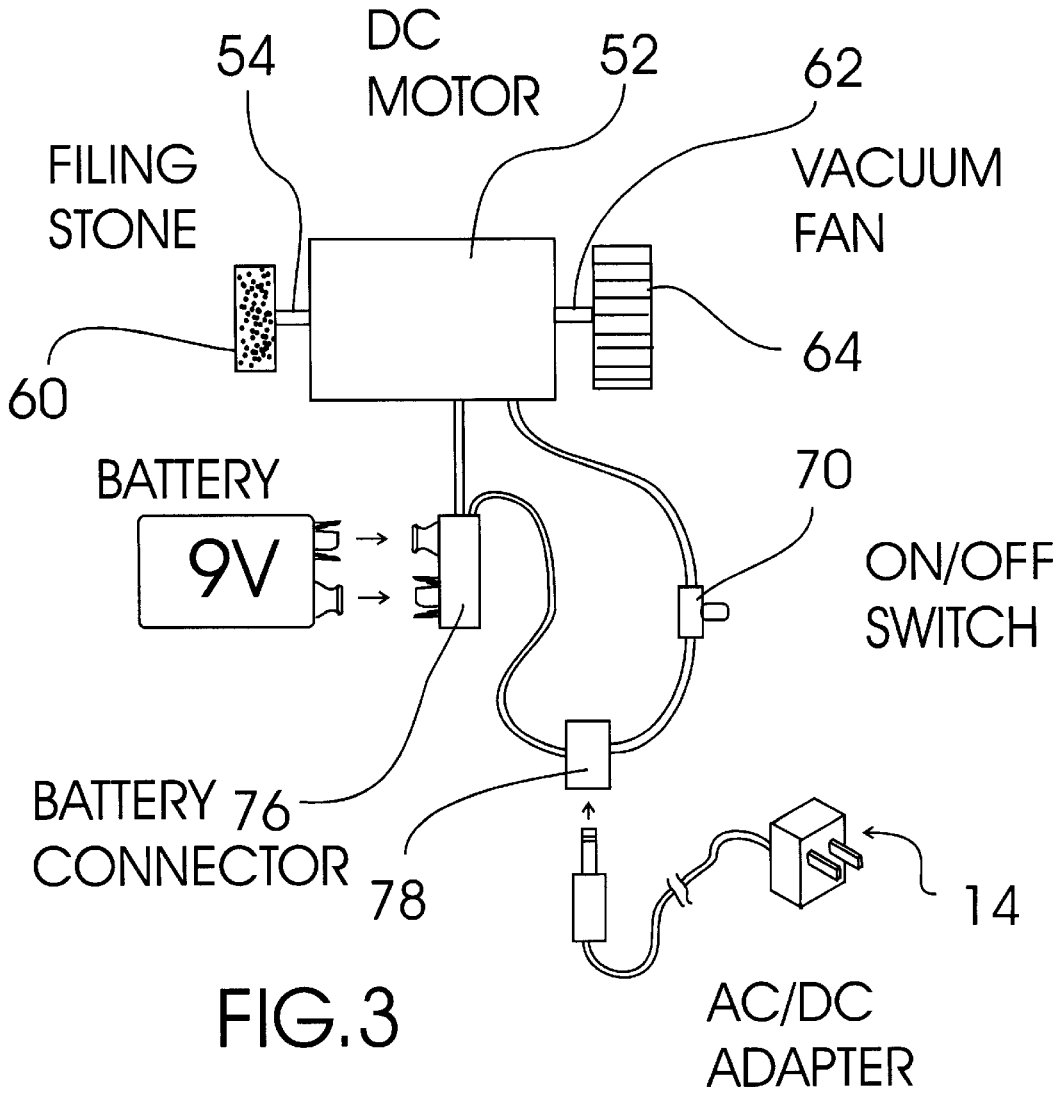
FIG. 3 is a schematic diagram showing the dual output shaft DC motor, the filing stone, the vacuum fan, the battery connector, the AC/DC adapter jack, the on/off switch, the AC/DC adapter, and a representative battery.

Vacuum assembly 12 includes a molded plastic housing 34 including a removable, vented filing stone cover 36, a pivoting vacuum chamber access door 38, a shroud connection opening 30 in corresponding connection with the open rear end 30 of clipper shroud structure 16, a number of finger receiving grooves 40 formed into a bottom surface thereof, a number of vacuum fan exhaust openings 42 formed through a back plate surface 44 thereof, referring now to FIG. 2, a battery chamber 46 formed therein, a DC motor cavity 48 formed therein, vacuum chamber 32 formed therein and a screen support structure 50 positioned between vacuum chamber 32 and DC motor cavity 48; referring now to FIG. 3, a dual shaft DC motor 52 positioned within DC motor cavity 48 having a first output shaft 54 passing through back plate surface 44 (FIG. 1) and in connection with a filing stone 60 and a second output shaft 62 in connection with a vacuum fan 64, referring back to FIG. 2, positioned within DC motor cavity 48 between DC motor 52 and screen support structure 50; an on/off switch 70 with an actuator portion 72 extending out of molded housing 34; a battery connector 76 in connection with an AC/DC adapter jack 78 (FIGS. 1 and 3), on/off switch 70 and DC motor 52 and positioned within battery chamber 46 of the molded housing 34; and a screen 80 positioned in connection with screen support structure 50 and sized to block an opening formed between DC motor cavity 48 and vacuum chamber 32.

Referring generally to FIGS. 1–3, in operation vacuum fan 64 draws air and nail clippings in through the clipper shroud structure, the vacuum chamber, where screen 80 screens out the clippings while the air continues into vacuum fan 64 and is discharged out through DC motor cavity 48 and vacuum fan exhaust openings 42 formed through back plate surface 44 of molded housing 34. Removable, vented filing stone cover 36 is attachable to molded plastic housing 34 such that filing stone 60 is concealed therein.

It can be seen from the preceding description that a nail clipper accessory has been provided that includes a vacuum assembly and a resilient tubular clipper shroud structure; the tubular clipper shroud structure being formed of a resilient flexible plastic and having a clipper lever shaft positioning slot formed into a top front surface thereof, an open front end for receiving a back portion of a nail clippers and an open rear end in connection with a vacuum chamber of the vacuum assembly; the vacuum assembly including a molded plastic housing including a removable, vented filing stone cover, a pivoting vacuum chamber access door, a shroud connection opening in connection with the open rear end of the clipper shroud structure, a number of vacuum fan exhaust openings formed through a back plate surface thereof, a battery chamber formed therein, a DC motor cavity formed therein, a vacuum chamber formed therein and a screen support structure positioned between the vacuum chamber and the DC motor cavity; a dual shaft DC motor positioned within the DC motor cavity having a first output shaft passing through the back plate surface and in connection with a filing stone and a second output shaft in connection with a vacuum fan positioned within the DC motor cavity between the DC motor and the screen support structure, an intake end of the vacuum fan being oriented toward the screen support structure and an output end of the vacuum fan being oriented toward the back plate surface; an on/off switch with an actuator portion extending out of the molded housing; a battery connector in connection with the on/off switch and the DC motor and positioned within the battery chamber of the molded housing; and a screen positioned in connection with the screen support structure and sized to block an opening formed between the DC motor cavity and the vacuum chamber; the vacuum fan drawing air in through the clipper shroud structure, the vacuum chamber, and the screen and discharging the air out through the DC motor cavity, and the vacuum fan exhaust openings formed through the back plate surface of the molded housing when the DC motor is in operation; the removable, vented filing stone cover being attachable to the molded plastic housing such that the filing stone is concealed therein.

It is noted that the embodiment of the nail clipper accessory described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A nail clipper accessory comprising:

a vacuum assembly; and a resilient tubular clipper shroud structure attached to said vacuum assembly;

said tubular clipper shroud structure being formed of a resilient flexible plastic and having a clipper lever shaft positioning slot formed into a top front surface thereof, an open front end for receiving a back portion of a nail clipper and an open rear end in connection with a vacuum chamber of said vacuum assembly;

said vacuum assembly including:

a molded plastic housing including a removable filing stone cover, a pivoting vacuum chamber access door, a shroud connection opening in connection with said open rear end of said clipper shroud structure, a number of vacuum fan exhaust openings formed through a back plate surface thereof, a battery chamber formed therein, a DC rotor cavity formed therein, a vacuum chamber formed therein and a screen support structure positioned between said vacuum chamber and said DC motor cavity;

a dual shaft DC motor positioned within said DC motor cavity having a first output shaft passing through said back plate surface and in connection with a filing stone and a second output shaft in connection with a vacuum fan positioned within said DC motor cavity between said DC motor and said screen support structure, an intake end of said vacuum fan being oriented toward said screen support structure and an output end of said vacuum fan being oriented toward said back plate surface;

an on/off switch with an actuator portion extending out of said molded housing;

a battery connector in connection with said on/off switch and said DC motor and positioned within said battery chamber of said molded housing; and a screen positioned in connection with said screen support structure and sized to block an opening formed between said DC motor cavity and said vacuum chamber;

said vacuum fan drawing air in through said clipper shroud structure, said vacuum chamber, and said screen arid discharging said air out through said DC motor cavity, and said vacuum fan exhaust openings formed through said back plate surface of said molded housing when said DC motor is in operation;

said removable filing stone cover being attachable to said molded plastic housing such that said filing stone is concealed therein.

* * * * *